United States Patent [19]

Ali

[11] 4,200,947

[45] May 6, 1980

[54] ROTARY STRIPPER DEVICE

[76] Inventor: Frank F. Ali, 2973 Pascal Dr., Fairborn, Ohio 45324

[21] Appl. No.: 871,507

[22] Filed: Jan. 23, 1978

[51] Int. Cl.[2] ..... A46B 7/10; A46B 13/00

[52] U.S. Cl. ..... 15/198; 29/81 J; 51/331; 125/5

[58] Field of Search ..... 15/89-93, 15/141 A, 197-200, 104.04, 104.14, 5, 366; 125/5; 29/81 H, 81 J, 81 L; 17/18, 64, 67; 51/331-337

[56] References Cited

U.S. PATENT DOCUMENTS

| | | | |
|---|---|---|---|
| 188,132 | 3/1877 | Haskins | 15/198 |
| 462,157 | 10/1891 | Pederson | 15/104.14 X |
| 634,328 | 10/1899 | Freeman | 15/198 X |
| 695,231 | 3/1902 | Preston et al. | 17/18 |
| 1,082,922 | 12/1913 | Bemis | 15/201 X |
| 1,153,738 | 9/1915 | Devoorde | 15/93 R |
| 1,171,962 | 2/1916 | Kinan | 15/198 |
| 1,414,305 | 4/1922 | Sandblom | 15/198 X |
| 1,535,628 | 4/1925 | Peterson | 15/198 |
| 3,386,118 | 6/1968 | Morioku et al. | 15/201 X |

FOREIGN PATENT DOCUMENTS

| | | | |
|---|---|---|---|
| 83032 | 6/1957 | Denmark | 29/81 J |
| 335724 | 10/1930 | United Kingdom | 29/81 J |

*Primary Examiner*—Peter Feldman
*Attorney, Agent, or Firm*—Jerome P. Bloom

[57] ABSTRACT

A rotary stripper, which can be chucked to a drive shaft, comprises a pair of discs spaced by a centrally positioned intermediate hub which has radial slots. Immediately outward of the hub and arranged in a ring concentric thereto are a series of equidistantly spaced pins, the axes of which are parallel to the central axis of the hub. The location of the pins, in a circular sense, places one thereof at and in adjacent relation to the outer end of each slot, offset from a direct alignment with the slot. The offset in each case is in a direction counter to that in which the hub is intended to rotate in use.

Stripper elements which are relatively rigid but have a minor degree of flexibility are simultaneously slip fit to each pin and in the slot adjacent thereto and are resiliently mounted thereby to the hub. The stripper elements are contained by the discs to either end of the hub. One of these discs is integral with the hub and the other releasably attached to the pins, the axial length of which is slightly greater than that of the hub.

In preferred embodiments the stripper elements are free to float in a sense axially of the hub.

15 Claims, 8 Drawing Figures

FIG-3
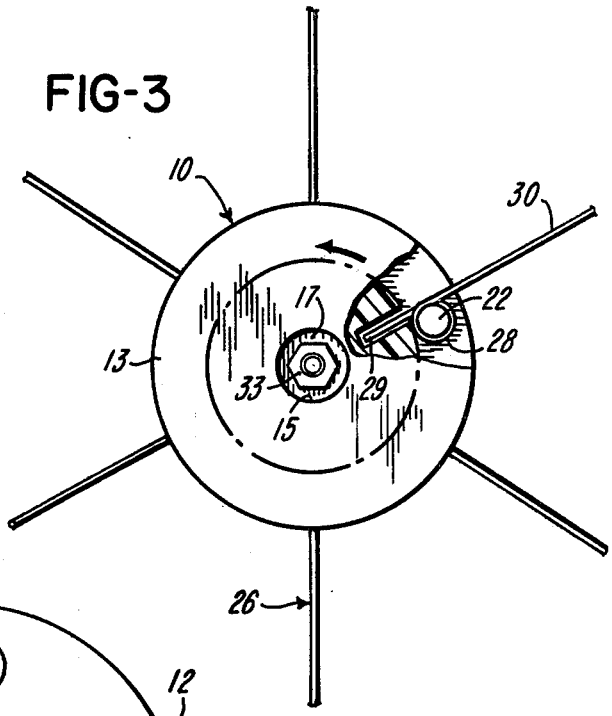
FIG-2
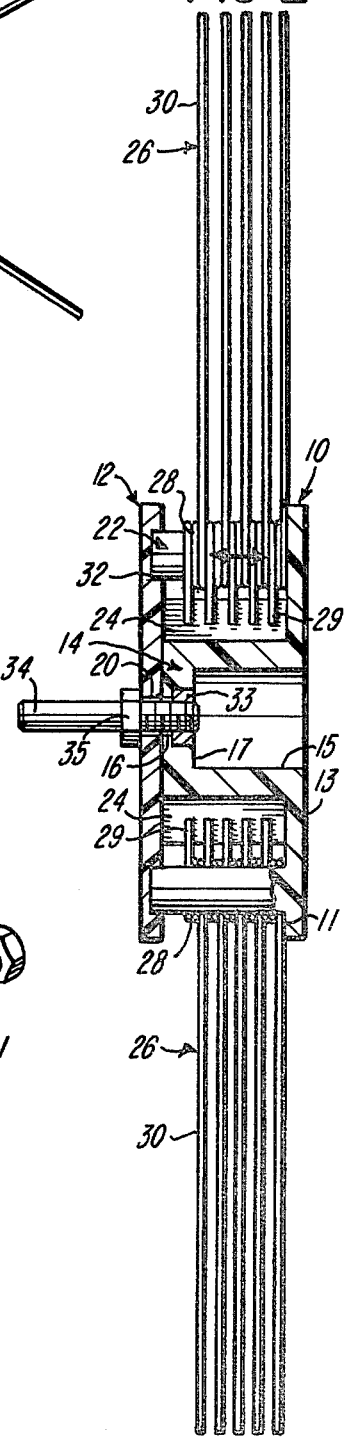
FIG-4
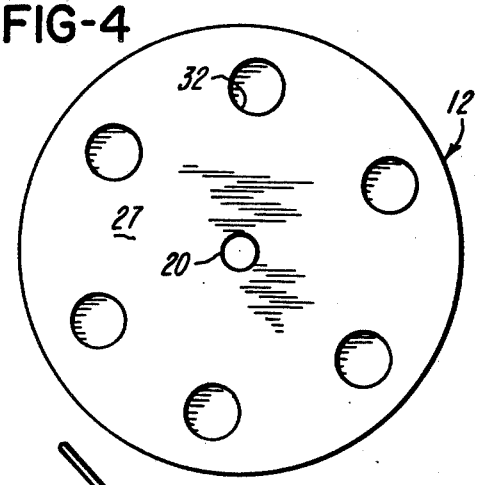
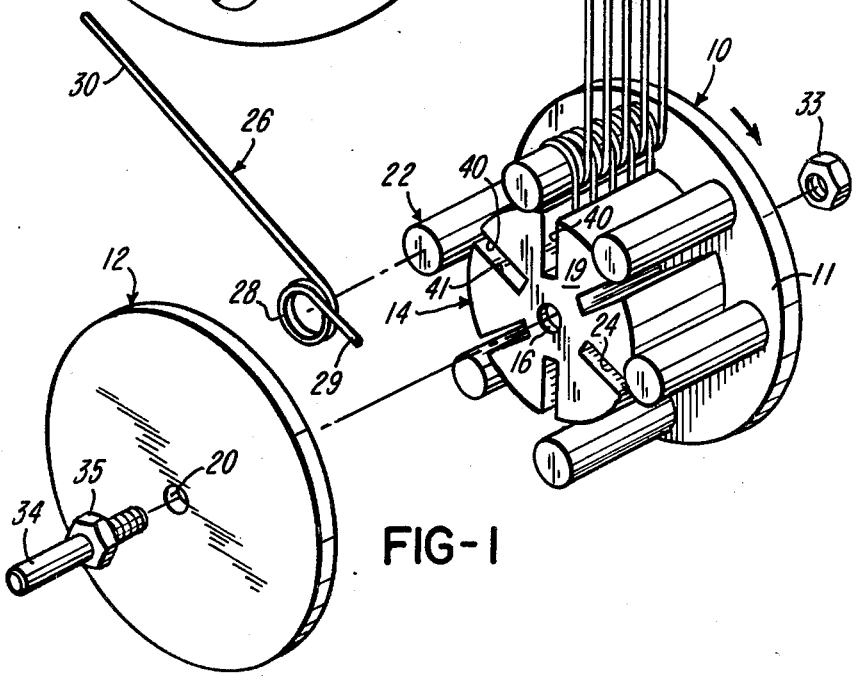
FIG-1

FIG-7
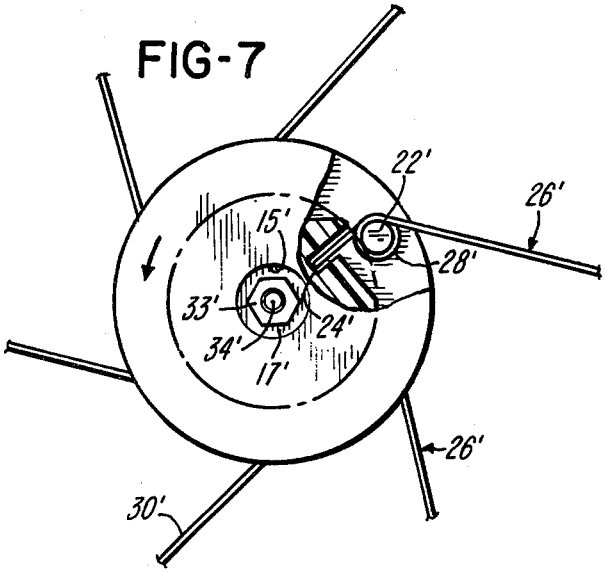
FIG-6
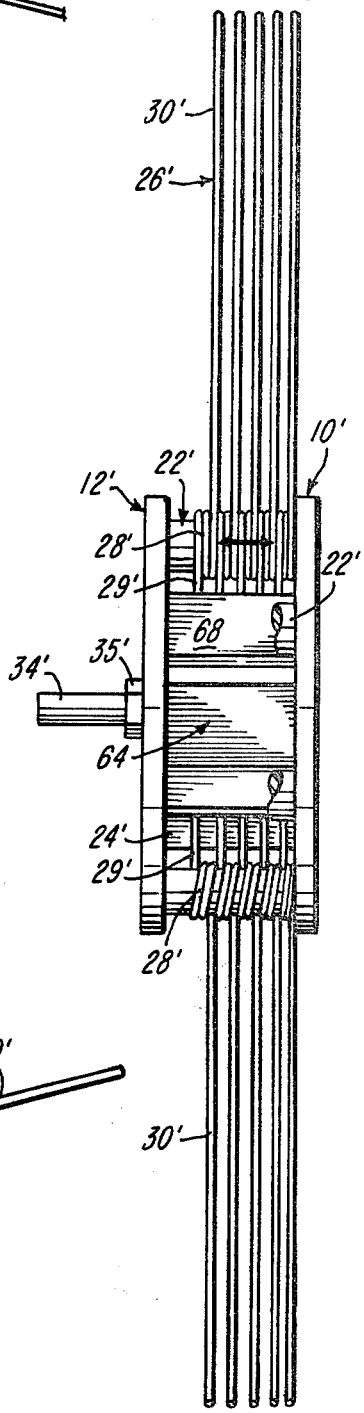
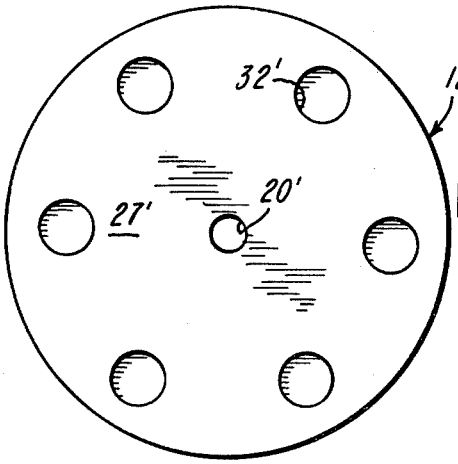
FIG-8
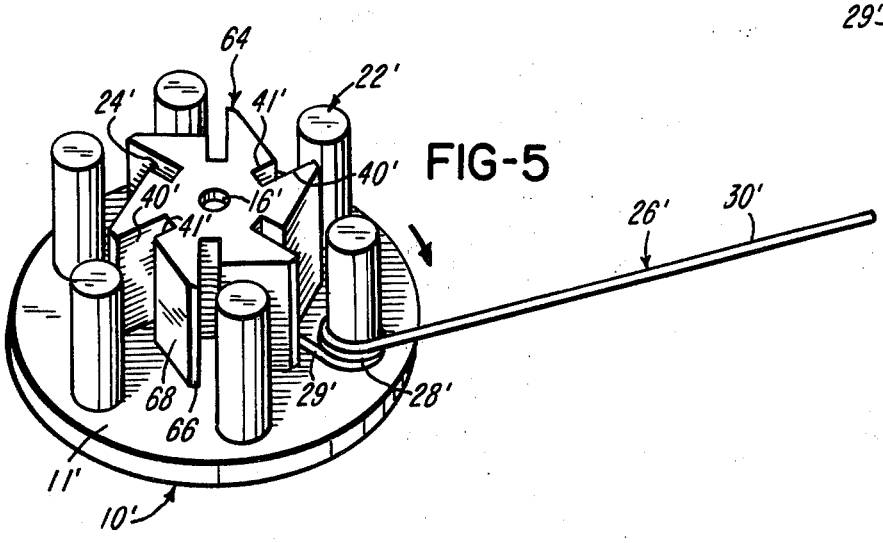
FIG-5

ROTARY STRIPPER DEVICE

BACKGROUND OF THE INVENTION

This invention relates to improvements in rotary stripper devices which make them more economical to fabricate, more efficient and satisfactory in use, and adaptable to a wider variety of applications.

Similarly applicable devices of the prior art leave much to be desired from the standpoint of construction, cost and quality of performance. For reasonably satisfactory results in their use they must be handled by a skilled craftsman since chatter and gouging or otherwise marring the surfaces to which they are applied will often times occur. A further disadvantage found in prior art devices is the difficulty of their repair.

Of the prior art the only one of which the inventor is aware that bears any pertinence whatsoever to the present invention is that illustrated in U.S. Pat. No. 3,958,294.

SUMMARY OF THE INVENTION

Embodiments of the present invention have a construction which not only obviates the above mentioned problems but they provide a tool which can be employed by one having little or no previous experience in stripping and with highly satisfactory results.

Preferred embodiments of the invention comprise a slotted hub and stripper means mounted peripherally of the hub and in the slots thereof to project outwardly of and to resiliently mount in a predetermined floating relation to the hub.

The stripper means are each preferably formed of a wire which has a minor degree of flexibility. The wire is coiled on itself to form a loop therein which is located in adjacent spaced relation to one end, which may be considered the inwardly disposed end of the stripper means. By means of this loop the wire may be slipped over one of a series of circularly spaced pins which position concentric to and immediately about the hub. The inner end of the wire is simultaneously slipped in an adjacent slot in the hub. The pins are formed integral with and to project perpendicular to a peripherally projected portion of a disc which abuts and is connected in a fixed relation to one end of the hub and they are capped by a second releasable disc which abuts the opposite end of the hub.

The features of the invention and the construction of their embodiments provide a rotary stripper which, depending on the material of which the stripper means are formed, is a simple, effective, and easily employed means which may be used to strip paint, rust and barnacles and various other surfaces from a wide variety of materials. Those embodiments in which the stripper means float in a contained relation to the hub afford means for achieving a particularly desirable relatively smooth stripping action without damage to the underlying material or construction of the object to which the rotary stripper is applied.

A primary object of the invention is to provide a rotary stripper which is economical to fabricate, more efficient and satisfactory in use, adaptable to a wide variety of applications and unlikely to damage the article to which it is applied.

Another object is to provide a rotary stripper wherein the stripper means is contained in and resiliently mounted in floating relation to a hub.

A further object is to provide a rotary stripper wherein the stripper elements are slip fit to pins surrounding a slotted hub in the slots of which their innermost ends are slip fit simultaneous with their application to said pins, whereby to mount the outer ends of the stripper elements in a predetermined projected relation to the hub. An additional object is to apply the stripper elements so mounted so the slot in which the inner end of each stripper element is fit is offset from a direct alignment with the pin to which the stripper element mounts in that direction in which the rotary stripper will rotate in use.

Another object of the invention is to provide a rotary stripper possessing advantageous features and inherent meritorious characteristics such as disclosed in the embodiments herein described.

A further object is to provide a rotary stripper which can be readily assembled and disassembled to facilitate replacement of parts.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

FIG. 1 is an exploded perspective view of one form of embodiment of the invention;

FIG. 2 is a sectional view of the apparatus of FIG. 1 parts being broken away for clarity of disclosure;

FIG. 3 is a plan view of the embodiment, as seen from the outer end thereof, partly broken away for clarity of disclosure;

FIG. 4 is a plan view of the inside surface of the releasable disc of the assembly of FIG. 1;

FIG. 5 is a perspective view of the hub and integrated disc portion of a preferred modification of the embodiment of FIGS. 1–4;

FIG. 6 is a sectional view of this preferred embodiment, parts being broken away for clarity of disclosure;

FIG. 7 is a plan view of the device of FIGS. 5–6 taken from the outer end thereof parts being broken away for clarity of disclosure; and FIG. 8 is a plan view of the inside surface of the releasable disc portion of the device of FIGS. 5–7.

Like parts are indicated by similar characters of reference throughout the several views.

DESCRIPTION OF THE ILLUSTRATED EMBODIMENTS

In its assembled form, the embodiment of FIGS. 1–4 includes a pair of plate-like discs 10 and 12, molded of high strength plastic material, established in a spaced apart parallel relation by an intermediately positioned generally cylindrically configured hub 14 the outer diameter of which is smaller than that of the discs. The hub 14 is molded integral with, centered on and projected perpendicular to the inner face 11 of the disc 10.

The part comprised of the disc 10 and the hub 14 has a cylindrical cavity 15 which opens at one end from the center of the outer face 13 of the disc 10. The cavity 15 extends inwardly and axially of the hub and its base 17 lies in a plane adjacent and generally parallel to the projected end face 19 of the hub 14. A small aperture 16 in the base of the cavity 15 opens through the center of the hub face 19 and is continued by a central aperture 20 in the disc 12. A circularly and equidistantly spaced series of pins 22 are formed integral with and perpendicular to the face 11 of the disc 10. The pins 22 are positioned about and in closely spaced relation to the outer cylindrical surface of the hub 14, parallel to its axis and immediately inward of the outer peripheral edge of the disc 10.

Formed in the body of the hub 14 are a series of equidistantly spaced, axially directed radial slots 24 which open both from its outer peripheral surface and that end thereof which is capped by the disc 12. In the example shown there are six slots and the radial depth of each slot is about one half that of the hub 14.

The pins 22 are also six in number. Their axial length is slightly greater than that of the hub and each pin 22 is located in a general alignment with one of the slots 24, offset from a radial alignment therewith by about one half the width of the slot. The offset of the pin in each case is in a direction counter to that direction in which the hub will rotate in use of the rotary stripper assembly of which it forms a part.

Mounted on and for movement axially of each pin 22 and within the adjacent slot 24 in the hub 14 are a plurality of stripper elements 26. Each element 26 is comprised of a short straight length of wire which is relatively rigid and has a minor degree of flexibility. Each wire element 26 is coiled on itself to form a loop 28 therein adjacent and spaced from one end which may be considered its inner end. The diameter of the loop 28, which is comprised of plural turns of the wire, is made slightly greater than that of a pin 22 so the wire may be slip fit to a pin by dropping its loop over the projected end thereof. The short inner end portion 29 of the wire 26 and its longer outer end portion 30 are extended tangential to loop, respectively from its axially spaced end portions and in a common plane.

The stripper elements 26 are applied to the pins 22 with the disc 12 removed from its end abutted relation to the projected end surface 19 of the hub 14. As each wire element 26 has the loop 28 thereof slipped over a pin 22, its shorter end portion 29 is simultaneously slipped into the open end of the adjacent slot 24 in the hub 14. The outer end portion 30 of the wire is established thereby to project outwardly of the hub and connected discs, in a sense radially thereof.

The face 27 of the disc 12 which positions inwardly of the rotor assembly is provided with a circularly spaced series of socket-like recesses 32 which, as the central portion of the face 27 is abutted to cap the end face 19 of the hub 14, position in concentric relation to the hub to nest therein, and in a frictionally contained relation thereto the projected ends of the pins 22.

Thus, as may be seen with reference to FIGS. 1–4 of the drawings, prior to application of the disc 12, a plurality of stripper elements 26 are dropped over each pin 22 so as to have inner end portions 29 thereof slidably received within and simultaneously contained by the bounding wall portions of the adjacent slot 24. According to a preferred arrangement and concept of the invention, the stacked loops 28 of the wire stripper elements applied to any one pin will in their composite have an axial length less than that of the hub 14 and in the example illustrated about 15–20% less. Therefore, when the disc 12 is applied in end abutting relation to the hub 14 to cap the open ends of the slots 24 and to nest the pins 22 with an interference fit in its socket-like recesses 32, the wires 26 are not only contained to the rotor assembly of which they form a part but they are left with a limited space to move in a sense axially of and back and forth on the pins 22 and within the slots 24.

The base surface 17 of the cavity 15 is counterbored and the wall of this counterbore, in cross section, is configured to precisely nest a hex nut 33 which is fixed therein. The nut 33 is threadedly engaged by a short drive shaft element 34 thrust through the disc 12 and into the cavity 15 by way of the apertures 20 and 16. A further nut 35 is engaged about a threaded surface portion of the shaft 34 which disposes outwardly of the disc 12 as the inner end thereof is engaged in and to the nut 33. As the nut 35 is turned on the shaft 34 to abut the outer surface of the disc 10, the shaft 34 will then be fixed to project outwardly of and perpendicular to the disc 12 and the rotor assembly of which it forms a part.

As will be obvious, the basic rotor assembly requires no fasteners and the stripper elements thereof have a resilient floating mount not only on the pins 22 but also in the slots 24 of the hub 14. This is a significant development in the art of fabricating and using wire type rotary strippers, above and beyond the basic advantages of a rotor construction such as here provided. To use the rotary stripper of the invention one need only connect the shaft 34 or other suitable drive element by means of which the rotary stripper device may be chucked to a powered drive shaft in a manner well known to those versed in the art. When power is applied, the rotary stripper will be arranged to turn about its central axis with the wires 26 leading the pins 22 to which they mount. The developed centrifugal force will cause the wires to project in a sense radial to the hub, under no load conditions. As the projected extremities of the end portions 30 of the wires are applied to a surface finish or encrustations on a surface of an object to be stripped thereof, their inner end portions 29 will bear against the leading wall surface portions 40 of the slots 24 in which they are disposed, the surface portions 40 being in advance of the wires, considering the direction of their rotation. This produces a resistance of the wires to a displacement from their generally radial orientations, established by the original restraint thereof by reason of the slip fit of their inner end portions between the closely spaced side walls 40 and 41 of slots 24. The limited flexibility of the wires so applied insures a stripping engagement and function of the wires which is firm and positive. The result is a rapid, and relatively uniform, substantially chatter free stripping operation minimizing subsequent sanding or cleaning requirements. More than this, in the preferred embodiment where the wires are free to float back and forth on and axially of the pins 22 and slots 24, the surface stripped is left essentially free of gouging and severe markings. The finish which can be achieved with a firm held tool having these features, without a pressured application of the stripper elements to the surface to which they are applied, is unexpectedly uniform and reasonably smooth and these results may be achieved by one having little knowledge or skill in using such tools.

One may, if one desires, have the wires 26 stacked on each pin from end to end thereof so free floating is not possible and have a construction still including features of improvement affording considerable advantage over prior devices directed to similar applications. However, for maximum benefit the floating feature should be retained.

It will be obvious that the stripper elements may comprise wires of metal having different diameter, the diameter being dependent on the application, with smaller diameter wires being used on softer surface materials. Other elements may be substituted for the wire stripper elements for applications which demand a less rugged stripper construction. As a matter of fact materials other than metal may be employed for the stripper where more of a polishing function may be desired.

Note that the side walls of each slot 24 are in any case closely spaced to insure a closely contained relation of the inner ends of the wires and a resilient mount of the wires tending to hold them in a predetermined relation to the hub precluding interference between or misalignment of the wires while permitting a relative freedom of the wires to adjust to extreme conditions. This last protects against damage to the stripper elements. In any case the positive mount and/or floating relation of the wires to their guiding hub, in their preferred embodiment, affords unexpected improvements in surface finish, even in a rugged stripping function thereof.

FIGS. 5–8 show a modification of the device of FIGS. 1–4 constituting a preferred embodiment of the present invention. Most of the parts of this embodiment are like those of the embodiment first described and to this extent will be identified by like numbers having a "prime" symbol.

Thus the embodiment of FIGS. 5–8 includes a pair of plate-like discs 10' and 12' established in a spaced apart parallel relation by a hub and a circularly spaced series of pins 22'.

In this case, the hub, identified by the numeral 64, is modified as to its outer peripheral surface configuration. The hub 64 is, nevertheless, molded integral with, centered on, and projected perpendicular to a central portion of the inner face 11' of the disc 10'. Moreover, its outermost peripheral surface does include six relatively narrow axially oriented portions 66, the length thereof, which are circularly and equidistantly spaced and which correspond to portions of a cylindrical surface such as provided on the outer periphery of the hub 14.

The hub 64 is also provided with a series of radial slots 24' which are circularly and equidistantly spaced and extend axially of its outer peripheral surface. As in the first described embodiment, the slots commonly open from that end 19' of the hub which is capped by the releasable disc 12' and the inner end of each slot is at a point approximately one-half the maximum radius of the hub. In this case, however, the radial length of what might be considered the leading wall surface 40' of each slot 24' is about twice that of its trailing wall surface 41'.

One axially oriented edge of each surface portion 66 of the hub coincides with that edge defining the outer radial limit of a side wall surface portion 40' of a slot 24'. The other closely spaced parallel edge of each surface portion 66 coincides with what may be considered the trailing edge of a portion 68 of the outer peripheral surface of the hub the leading edge of which coincides with the outer radial edge of a side wall surface portion 41' of a slot. The surface portion 68 in each case defines a plane at right angles to that of the side wall surface 41' which it joins. The arrangement of the axially directed slots 24' and their bounding wall surfaces together with the hub surface portions 66 and 68 as described define a peripheral configuration for the hub comprised of a cylindrical root portion the outer surface of which is circumscribed by the inner wall surface portions of the slots from which radially projects a series of radially oriented fingers. The radial side walls of the fingers are defined in each case by a leading surface 41' and a trailing surface 40' and the outer end of the finger is defined in each case by angularly related surface portions 68 and 66 which extend the length of the hub 64. The hub 64 thus has a series of circularly and equidistantly spaced radial fingers defining an equal number of circularly and equidistantly spaced radial slots.

The pins 22' mount integral with and project from the surface 11' of the disc 10', adjacent and about the hub 64 in a manner similar to that provided for the pins 22 by the mount thereof to the disc 10 and about the hub 14. The pins 22' are also longer than the hub 64 and their relatively projected ends have an interference fit in sockets 32' provided in the inner face 27' of the disc 12'. the disc 12' is of course identical in construction and application to the disc 12.

In addition, the pins 22' are located so each one thereof is positioned with reference to a slot 24' to be adjacent the outer end of the slot and offset immediately to one side of the slot in that direction which is opposite the direction to that in which the hub will rotate in use of the stripper assembly. The width of each slot 24' is narrow and in this case the outer radial limit of the wall surface 41' of the slot adjacent to the pin has a greater spacing from the pin 22' immediately outward thereof than that provided between a pin 22 and a wall surface 41 in the embodiment first described.

in this preferred embodiment of the invention of FIGS. 5–8 the stripper elements 26' are each shown as a wire coiled upon itself to form a loop 28' therein adjacent and spaced from one end. The arrangement is such that the shorter inner end portion 29' and the longer outer end portion 30' of each wire extends tangential to its loop 28'. The outer end portion 30' of the wire is in this instance bent out of a coplanar relation with the inner end portion 29' to form therebetween an included angle in the neighborhood of 135°.

In the assembly of the wires 26', they are slipped on to the pins 22' so as to have their inner end or tail portions 29' simultaneously slip fit in the adjacent slot 24' in each case. Of course, the wires are applied to the pins and in the slots of the hub while the cap plate or disc 12' is removed. In the preferred embodiment shown in FIGS. 5–8 five wires are applied to each pin to have their coil portions 28' stacked upon and about the pin. With the disc 12' applied to the projected ends of the pins and abutted to the end face 19' of the hub 64, this will leave a space along each pin the axial length of which is about that of a coil of a single wire. The inner ends 29' of the wires in each slot 24' will be axially spaced and slight lateral play will be permitted for these ends by reason of the fact the spacing of the side wall portions 40' and 41' of the slot though close will not be rigidly confining. The arrangement is such, by reason of the slip fit of the coils 28' and the slight play permitted for the end portions 29' that in a static condition of the rotor assembly the wires will not precisely align in all respects as they project from the hub and the rotor assembly of which they form a part. However, as the rotor assembly is chucked to a power drive shaft by means and in a manner as previously described and the rotor assembly energized and rotated, the wires will uniformly align in an axial sense and project outwardly in a predetermined relation to the hub, controlled as to their orientation by their slip fit confinement in and by the walls of the slots 24'.

As the outer ends of the wires are applied to a surface to be stripped, by reason of their mount to the pins 22' and the hub 64 and their relatively limited give, they need only be lightly applied to achieve a fast and effective surface treatment and in the process no scarring, heavy grooving or damage to the surface or to the applied stripper elements will result. In the stripping process the inner ends 29' of the wires will bear on the immediately forward side wall surface portions 40' of the slot in which they position. If by chance the projected ends of the stripper elements encounter an unexpected projection from the surface to which they are applied, the limited play of the inner ends of the wires in the slots 24' in which they nest provides sufficient accommodation for the shock to avoid damage to the stripper elements or the surface being stripped. This lends ease and safety in handling the tool which embodies the rotary stripper assembly. The arrangement is such to accommodate problems with safety to the user while permitting the tool to function in an optimal manner.

The unitized part comprised of the disc 10' and hub 64 as in the case of the disc 10 and hub 14 of the embodiment first described has a cavity 15' opening from the outer face 13' of the disc 10' and a central aperture 16' in its base 17'. The cavity 15' is formed exactly as the cavity 15 and arranged to receive the inner end of a drive shaft 34' which threadedly engages to a hex nut 33' fixed in a counterbore of the aperture 16' in the base 17'. The shaft 34' has applied thereto and in threaded engagement with the outer portion thereof a nut 35' which is clamped to the outer surface of the disc 10' to fix the shaft 34' in a position coaxial with and projected perpendicular to the rotor assembly.

Thus, the preferred embodiment of the invention is adapted for mounting and use the same as the first described embodiment. The differences in its construction, however, make it somewhat more effective and versatile in application. Its construction makes it lighter in weight, thus reducing the load on the drive means to which it is applied. Moreover, the mount of its wires is optimal while preserving the basic and desirable free bearing relation of the inner ends thereof which tends to preserve their integrity and avoids breadage of the wires in use.

As noted previously, the invention embodiments have an ability for relatively delicate application yet they can achieve their desired function in a distinctly improved manner. This is an important advance in the art.

Thus, the units of the invention, though light weight, are rugged and easily manipulated and usable by any person having the desire and physical capability to lift and apply the tool. The tool of the invention does not require any heavy handed or forceful application in any case. As a matter of fact, the requirements in this respect in the use of a number of prior art tools proposed for similar application has often resulted in damage to the surface to which the tools are applied.

While not specifically pertinent to the present invention, the U.S. Pat. Nos. 3,246,378 and 2,984,053 were considered with reference to the present invention.

As in the case of the first described embodiment, the wires or other stripper elements of the second described embodiment may be loaded on pins 22' the length thereof. However, the preservation of a free space on the pins, as taught herein, to enable a floating of the pins in an axial sense, in use, will produce an uniquely satisfactory finish in the application of the tool.

The foregoing is apart from the fact that the stripper elements in a device in accordance with the present invention may be easily and quickly interchanged as well as assembled and replaced. The tool of the invention may therefore be used with a variety of stripper elements differing as to their material, construction and size and be quickly adapted for one or another application.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. A rotary stripper device comprising a hub assembly, a plurality of stripper elements projecting peripherally of said hub assembly and in circumferentially spaced relation thereto, said hub assembly including as one part thereof means mounting said stripper elements in connection therewith and to have end portions project generally radially outwardly therefrom, the connections being formed to accommodate a floating movement of said stripper elements and the projected outer ends thereof in a sense generally longitudinally of said hub assembly, said hub assembly including as another part thereof means defining opposed surfaces for receiving and containing therebetween and serving as a guide for inner end portions of said stripper elements accommodating and maintaining their floating movement in a controlled path and in a sense generally longitudinally of said hub assembly on rotation of said mounting means and application thereof to a surface to be worked, said another part of said hub assembly being spaced radially inward from said one part thereof, the arrangement precluding interference between or misalignment of said stripper elements and their projected ends.

2. A rotary stripper device comprising a plurality of stripper elements, means mounting said stripper elements including a hub, means to control the orientation of said stripper elements with reference to said hub, said mounting means including pins arranged in a generally parallel spaced relation to and disposed in a circumferentially spaced relation about said hub, said stripper elements having a slip fit to said pins and said hub being formed with slots, to provide said control means, in which portions of said stripper elements are slip fit to establish them in a predetermined projected relation to said hub.

3. A rotary stripper device as in claim 1 wherein said hub assembly includes a central hub portion having defined therein a plurality of longitudinally extending grooves to provide said opposed surfaces and said inner end portions of said stripper elements are projected in said grooves to guide said stripper elements in said controlled path and in a sense longitudinally of their mounting means and said hub assembly.

4. A rotary stripper device comprising a plurality of stripper elements, means mounting said stripper elements including a hub, said stripper elements having an axial floating mount to and being movable in a controlled path and in a predetermined relation to said hub on rotation of said mounting means and application thereof to a surface to be worked, said mounting means including pins arranged in a generally parallel spaced relation to and disposed in a circumferentially spaced relation about said hub, said stripper elements having a slip fit to said pins and said hub being formed with slots in which portions of said stripper elements are slip fit to establish them in said predetermined relation to said hub and for said movement in said controlled path.

5. A rotary stripper device comprising a plurality of stripper elements, means mounting said stripper elements including a hub, said stripper elements having an axial floating mount to and being movable in a controlled path and in a predetermined relation to said hub on rotation of said mounting means and application thereof to a surface to be worked, said hub including a plurality of generally radially projected fingers which define therebetween a plurality of circumferentially spaced slots and end portions of said stripper elements having a confined but relatively free floating mounting within and for movement in a sense longitudinally of said slots.

6. A rotary stripper as in claim 5 wherein said hub has a generally cylindrical outline and is confined between plate-like elements which cap and project outwardly of the outer ends of said slots.

7. A rotary stripper as in claim 5 wherein said stripper elements have the form of wires the inner ends of which project in and are movable in a sense longitudinally of said slots and the side wall portions of said slots serve as restraints limiting the lateral movement of said inner ends of said wires on the rotation of said mounting means and the application of the outer ends of said wires to a surface to be stripped.

8. A rotary stripper as in claim 5 wherein said hub is confined between plate-like elements which cap the respective ends thereof and one of said plate-like elements is releasable to provide for the application of said stripper elements to or the removal thereof from their mounting means and said hub.

9. A rotary stripper as in claim 8 wherein said plate-like elements are bridged by pins on and about which said stripper elements ride, as one end of each of said stripper elements projects freely in one of said slots to provide for said free floating mount.

10. A rotary stripper device comprising a plurality of stripper elements, means mounting said stripper elements including a hub, said stripper elements having a longitudinal floating mount to and being movable in a controlled path and in a predetermined relation to said hub on rotation of said mounting means and application thereof to a surface to be worked, said hub having a body including equidistantly spaced peripheral slots commonly opening from one end thereof, a first disc being integrally connected to the opposite end of said hub and projecting peripherally thereof and a second releasable disc capping said one end of said hub, said discs and the hub which is positioned intermediately thereof defining a rotor assembly beyond the outer periphery of which said stripper elements project, and said mounting means for said stripper elements including means connected to at least one of said discs outward of the outer peripheral surface of said hub and portions of said stripper elements spaced radially inwardly of said mounting means being positioned in said slots.

11. A rotary stripper device comprising a plurality of stripper elements, means mounting said stripper elements including a hub, said stripper elements having a floating mount to and being movable in a sense axially of their mounting means, in a controlled path and in a predetermined relation to said hub on rotation of said mounting means, said hub having a body including equidistantly spaced peripheral slots commonly opening from one end thereof, a first disc being integrally connected to the opposite end of said hub and projecting peripherally thereof and a second releasable disc capping said one end of said hub, said discs and the hub which is positioned intermediately thereof defining a rotor assembly beyond the outer periphery of which said stripper elements project, and said mounting means for said stripper elements including means connected to at least one of said discs outward of the outer peripheral surface of said hub, said means connected to at least one of said discs beyond the outer surface of said hub including pins spaced circumferentially of said hub immediately adjacent its outer peripheral surface and parallel to the axis thereof, said pins extending between both said discs and said stripper elements being relatively rigid elements, having a limited degree of flexibility and embodying a loop by means of which they are slip fit to said pins and each having an end portion projected in one of said slots in said hub.

12. A rotary stripper comprising a rotor including means defining a plurality of wire-like stripper elements outer end portions of which project peripherally thereof and in circumferentially spaced relation thereto, mounting means for said elements which extend in a sense longitudinally of said rotor to which portions of said stripper elements, intermediate their ends, are rotationally mounted and slip fit, the free length of said mounting means being sufficient to accommodate a floating movement of said stripper elements which mount thereon towards one end or the other thereof, said floating mount being enabled by said slip fit, said rotor embodying means defining circumferentially spaced pairs of opposed surfaces spaced radially inwardly from said mounting means to contain portions of and guide said elements on their movement between the ends of said rotor in application to a surface to be worked, said last mentioned means including surface portions positioned in advance of said mounting means for said stripper elements having consideration for the direction of their rotation in use, said surface portions providing means against which innermost end portions of said stripper elements bias in use thereof.

13. A rotary stripper comprising a rotor including means defining a plurality of peripherally projected wire-like stripper elements and mounting means for said elements to which portions of said stripper elements, intermediate their ends, are rotationally mounted and slip fit for movement axially of said rotor, said rotor including means interrelated with said stripper elements to serve as an axial guide, said last mentioned means including surface portions positioned in advance of said stripper elements having consideration for the direction of their rotation in use, said surface portions providing means against which innermost end portions of said stripper elements will bias in use thereof, said rotor comprising a pair of discs and a hub intermediately of and capped by said discs, said hub including a series of circularly spaced slots, extending between said discs, and having, immediately outward thereof, pins connected to extend parallel to its longitudinal axis providing said mounting means for said stripper elements, said stripper elements being formed to slip fit on said pins and to have inner portions thereof each accommodated in one of said slots which is positioned adjacent thereto while other portions are controlled thereby to have a predetermined projected relation to said rotor.

14. A rotary stripper as in claim 13 wherein said pins are arranged so that each thereof is immediately outward of the outer radial limit of one of said slots and offset therefrom, said stripper elements are wire elements formed with a loop adjacent and spaced from one end, and a plurality of said stripper elements have a slip fit mount to each of said pins by means of their loops to provide that the shorter inner end portion of each thereof is projected in the adjacent slot to limit any tendency for pivotal motion of the stripper element of which it forms a part by engagement with the side walls of the slot while its outer end projects in a sense outwardly of said rotor, said stripper elements being controlled by the positions of their inner ends so as to provide a resilient mount thereof as the outer ends have their projected extremities applied to a surface to be stripped in a controlled fashion.

15. A rotary stripper as in claim 1 wherein said stripper elements are independent of one another and arranged in lines thereof extended longitudinally of said hub assembly and said lines are spaced circumferentially of said hub assembly whereby said stripper elements may independently float in each line and in successive lines thereof in a longitudinally sense of said hub assembly.

* * * * *

UNITED STATES PATENT AND TRADEMARK OFFICE

CERTIFICATE OF CORRECTION

PATENT NO. : 4,200,947

DATED : May 6, 1980

INVENTOR(S) : Frank F. Ali

It is certified that error appears in the above-identified patent and that said Letters Patent are hereby corrected as shown below:

Col. 5, line 64, "projects" is corrected to read -- project --.

Col. 6, line 12, "the" is corrected to read -- The --;

line 25, "in" is corrected to read -- In --.

Col. 7, line 39, "breadage" is corrected to read -- -- breakage --.

Col. 12, line 6, (Claim 15, line 7) "longitudinally sense" is corrected to read -- sense longitudinally --.

Signed and Sealed this

*Twenty-sixth* Day of *August 1980*

[SEAL]

*Attest:*

SIDNEY A. DIAMOND

*Attesting Officer*

*Commissioner of Patents and Trademarks*